United States Patent [19]

Tarachand

[11] Patent Number: 4,544,904

[45] Date of Patent: Oct. 1, 1985

[54] COMPOSITE MAGNET AND MAGNETIC CIRCUIT

[76] Inventor: Kishore Tarachand, 928 Wright Ave. #107, Mountain View, Calif. 94043

[21] Appl. No.: 583,445

[22] Filed: Feb. 24, 1984

[51] Int. Cl.[4] ..... H01F 7/02

[52] U.S. Cl. ..... 335/302; 335/306; 335/303; 252/62.57; 252/62.62

[58] Field of Search ..... 335/302, 303, 306; 252/62.55, 62.57, 62.62

[56] References Cited

U.S. PATENT DOCUMENTS

| | | | |
|---|---|---|---|
| 3,328,195 | 6/1967 | May | 117/69 |
| 3,424,578 | 1/1969 | Strnat et al. | 75/213 |
| 3,457,445 | 7/1969 | Dochterman | 310/190 |
| 3,892,601 | 7/1975 | Smeggil et al. | 148/31.57 |
| 4,042,341 | 8/1977 | Smeggil | 428/678 |
| 4,103,195 | 7/1978 | Torossian et al. | 310/259 |
| 4,110,718 | 8/1978 | Odor et al. | 335/302 X |
| 4,124,736 | 11/1978 | Patel et al. | 428/622 |
| 4,151,432 | 4/1979 | Akimoto et al. | 335/302 X |
| 4,237,396 | 12/1980 | Bienkisop et al. | 310/154 |
| 4,275,113 | 6/1981 | Saito et al. | 428/323 |
| 4,325,757 | 4/1982 | Jandeska, Jr. et al. | 148/103 |
| 4,383,193 | 5/1983 | Tomite et al. | 335/302 X |

*Primary Examiner*—George Harris

*Attorney, Agent, or Firm*—Douglas A. Chaikin

[57] ABSTRACT

Disclosed herein is a composite permanent magnet and a circuit which employs a plurality of such magnets. The composite magnet combines discrete sections of a first magnet material with at least one discrete section of a second magnetic material. The first material has a high residual magnetic strength and a moderate energy product. The second material is many times more expensive than the first material and is characterized by a high residual magnetic strength and a high energy product.

Also disclosed is a circuit combining a plurality of such composite magnets. The circuit combines the above magnets in such a way that there is a reduction in magnetic leakage in the circuit.

7 Claims, 5 Drawing Figures

COMPOSITE MAGNET AND MAGNETIC CIRCUIT

FIELD OF INVENTION

This invention relates to permanent magnets and more specifically to composite permanent magnets and circuits incorporating such magnets.

BACKGROUND OF THE INVENTION

Permanent magnets have been known since 600 B.C. Since that time scientists and engineers have made various improvements. Many of these improvements are documented in Moskowitz "Permanent Magnet Design and Application Handbook" (Cahners Books International, Inc. 1976) at pages 4–7 which is incorporate herein by reference.

Modern developments in improving magnets have focused for some time on rare earth-transition (RE-TM) magnets. Such magnets have considerably stronger magnetic properties and are approximately 10 times stronger than iron magnets and five times stronger than ferrite magnets.

RE-TM magnets are made from rare earth-transition metal compounds. An accepted definition for such compounds is found in Jandeska, Jr. et al, U.S. Pat. No. 4,325,757 which states, "the chemical combination of a transition metal such as cobalt, nickel, iron, manganese and chrome and a rare earth element such as yttrium, lanthanium, cerium, praseodymium, neodymium, promethium, europium, gadolinium, terbium, dysoprosium, holmium, erbium, thulium, ytterbium, or samarium. The rare earth constituent may also be in the form of mischmetal, naturally occuring or refined combinations of rare earth elements . . . . The rare earth-transition metals suitable for use herein are those having high energy products. The energy product is a measure of the energy that a magnet material can supply to an external magnetic circuit such as a flux field for a D.C. motor, without demagnetizing."

While such RE-TM magnets have extremely desirable magnetic properties, they are difficult to form into shapes useful for a magnet. Consequently, they are extremely expensive. For instance, RE-TM magnetic materials are typically, 80 to 100 times the cost of Alnico magnets and 175–200 times the cost of ferrite magnets. However, the tremendous disparity in the cost has retarded the usage of RE-TM magnets in general commerce.

Recently, efforts have been made to use RE-TM powders in unconventional ways in order to utilize their superior magnetic properties while minimizing the cost. For example, U.S. Pat. No. 4,042,341 and 3,892,601 to Smeggil and Smeggil et al, respectively, which are both incorporated herein by reference have disclosed a method for deposition of substantially uniform layers of transition metal and rare earth metal at temperatures below 1000° C. for the desired thickness. The magnetic film deposited is composed of a plurality of RE-TM compounds depending on the properties desired. The metals are decomposed at 1000° C. to yield vapors, which are then condensed on a substrate to form a continuous, substantially uniform coating or layer of metal thereon.

Additionally, U.S. Pat. No. 4,325,757 supra, which is incorporated herein by reference, discloses a method for forming RE-TM powders directly into radially aligned thin, curved, permanent magnets, particularly for use as magnetic pole pieces. The magnets are preferably thin, self-supporting structures.

Despite the well-funded efforts of some very large and powerful companies as shown by the above disclosures, the processes described above are not likely to bring the RE-TM magnets into common commercial usage. Deposition equipment is expensive and requires very skilled operators. The method described for forming RE-TM powders in U.S. Pat. No. 4,325,757 supra is a complicated and labor intensive process, and is believed to be quite expensive.

The invention disclosed takes a novel approach to the problem of the difficult to work with and expensive high performance magnetic materials. Though simple in nature, the invention reflects a deep and well-reasoned understanding of magnetic materials.

SUMMARY OF THE INVENTION

Applicant has discovered that by physically combining discrete sections of a first magnetic material with a discrete section of a second very powerful magnetic material, a composite magnet results which yields properties very close to the second material. Preferably, the first material is barrium ferrite ($BaFe_2O_3$), while the second material is preferably a RE-TM magnet such as samarium cobolt ($SMCo_5$). In particular the composite comprises:

A. at least a first discrete section of a first magnetic material, the material, (1) having a high residual magnetic strength, and (2) having an energy product greater than 3 million G-Oe;

B. a second discrete section of a second magnetic material comprising at least $\frac{1}{3}$ by weight of the composite (1) dissimiliar to the first material, (2) having a high residual magnetic strength, (3) having an energy product of at least 15 million G-Oe, (4) having an intrinsic coercive force at least 3000 Oe; and C. the first material in contact with the second material and the first material surrounding at least 30% of the surface area of the second material.

The invention also includes a magnetic circuit, comprising:

a plurality of such composite magnets (above);

the magnets being located adjacent one another and coaxially aligned;

the magnets being spaced apart by a fixed air gap, such that the first material of one magnet is directly adjacent the first material of another magnet; and each adjacent magnet having a different polarity thereby creating alternating north and south poles, whereby strong lines of flux are created across the air gap by the directly adjacent first materials causing the lines of flux between adjacent second materials to be bowed away from the air gap.

With the adjacent second materials' lines of flux being caused to bow away from the air gap they are more efficiently focused to do work. There is a resultant loss of leakage and an increase in efficiency of the magnetic properties of the second material and the circuit as a whole. This discovery can be utilized for example in synchronous drive. The bowed lines of flux of the second material are focused and directed to their counterpart on an opposite side of such a synchronous drive. The focusing and directing of the second more powerful and more expensive magnetic material by the first less powerful and less expensive materials enables a fraction of the second material to be used to do the same work.

An object of this invention is to provide a composite magnet wherein a less expensive material is used in place of more expensive material and the overall performance of the magnet approaches the more expensive material.

Another object of this invention is to provide a magnetic circuit wherein a plurality of such composite magnets are used to reduce the overall magnetic leakage of the circuit.

Other advantages as set forth herein will now be explained in more detail with reference to the drawing.

DETAILED DESCRIPTION OF THE INVENTION

Figure 1:
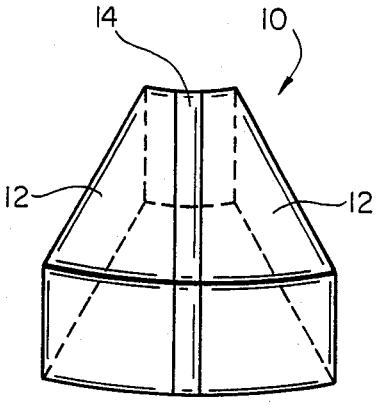
FIG. 1 is a perspective view of the composite magnet in accordance with this invention.
Figure 2:
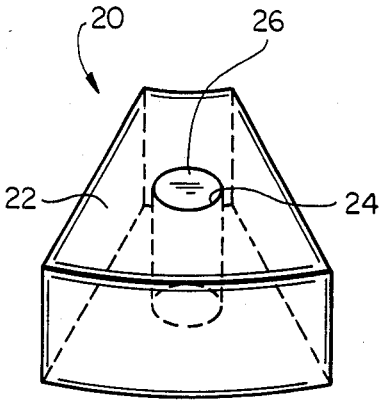
FIG. 2 is a perspective view of another embodiment of the invention.
Figure 3:
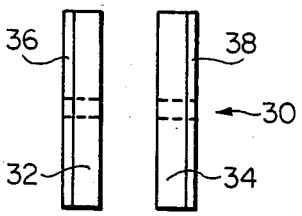
FIG. 3 is a side view of a synchronous drive including a plurality of the composite magnets of FIG. 1.
Figure 4:
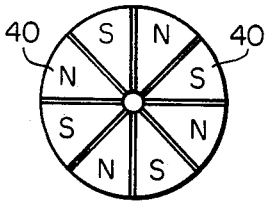
FIG. 4 is an enlarged view of one face of the synchronous drive.
Figure 5:
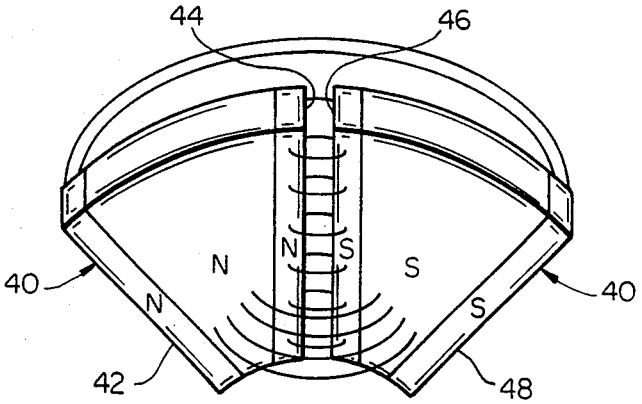
FIG. 5 is an enlarged view of two adjacent composite magnets of the synchronous drive.

With reference to the drawing, there is shown preferred embodiments of the invention. FIG. 1 and 2 show a composite magnet in accordance with this invention. FIGS. 3, 4 and 5 illustrate a magnetic circuit which uses a plurality of composite magnets of the type shown in FIG. 1.

With particular reference to FIG. 1 there is shown one embodiment of a composite magnet in accordance with this invention generally designated by the numeral 10. The composite magnet includes a first section 12 of a first magnetic material substantially surrounding and in contact with a second section 14 of a second magnetic material.

In the preferred embodiment shown in in FIG. 1 the first magnetic material comprises approximately two-thirds ($\frac{2}{3}$) by weight of the composite. The first material has a high residual magnetic force ($B_r$), which is the ability of the material to retain the magnetic moment alignment after the external magnetizing force is removed. There are basically two kinds of magnetic material, hard and soft. Soft magnetic material describes a ferromagnetic material in which all moment alignment is substantially lost when the external magnetizing field is removed. For example, iron and mild steel are considered soft. Hard magnetic materials are those which retain their magnetic properties after the field is removed. For the purpose of this invention, hard is synonymous with permanent magnet.

The first material is a hard magnetic material and has a $B_r$ of at least 3500 gauss (G).

The first material further is defined by its magnetic maximum energy product ($BH_{max}$). $BH_{max}$ is also written as $(B_d H_d)_{max}$, where $B_d$ (also known as remanence) is the magnetic induction retained by a magnet (with an air gap) after the initial magnetizing force is removed and $H_d$ is the force applied to a previously magnetized material to reduce the remanent to zero. The maximum energy product is the product of $B_dH_d$.

The first material has a maximum energy product of at least 3 million gauss-oersted (G-Oe).

Specific materials which meet the above magnetic requirements include $BaFe_2O_3$, many of the Alnicos and others. It has been found preferable by applicant to use $BaFe_2O_3$ for the first material.

The second material is dissimilar to the first material. Like the first material 12, the second material has a high residual magnetic strength and is a hard magnetic material. The second material has a much higher energy product $BH_{max}$, greater than 15 million G-Eo. In addition this second material has a high intrinsic coercive force ($H_{ci}$) of at least 3000 Oe and preferably greater than 9000 Oe.

Typically, materials found to meet such magnetic requirements include samarium cobalt $SmCo_5$ and cerrium copper. The applicant has found samarium cobalt to be particularly appropriate for the embodiment shown in FIG. 1.

A second embodiment of a composite magnet in accordance with this invention is shown in FIG. 2 and denoted generally by the numeral 20. The magnet 20 comprises a block 22 of the first magnetic material as described above. The block is drilled to make a hole 24. An insert 26 is fit snuggly within hole 24. The insert is made from the second magnetic material described above.

The first magnetic material ranges from a low to moderate cost, typically, from \$0.50 to \$6.00 per pound. On the other hand the second magnetic material is one of a family of rare earth-transition compounds as previously defined. The cost of such materials is very high, typically, \$100 per pound.

Applicant has found that by combining at least $\frac{1}{3}$ of the second magnetic material with the remaining portion the first magnetic material, costs are significantly reduced, while the magnetic characteristics of the composite is greatly improved over the first material and substantially approaches the magnetic characteristics of the second material. By contacting and substantially surrounding (at least 60%, and in some embodiments as great as 80%) the surface area of the second magnetic material with the first magnetic material, the results referred to above are achieved.

Alternatively, the sections may be held together by a layer of glue. For example, sections 12 and 14 could have a layer of epoxy therebetween for permanently bonding them together. The layer may be magnetic or non-magnetic without affecting the performance of the composite 10.

As will be described more fully hereinafter with reference to FIGS. 3–5, when a plurality of such composite magnets are combined into a magnetic circuit, greater than expected efficiencies are noted. In fact, the circuit performs at a level very close to what one would expect from a circuit using only the second material. The amount of flux leakage from the more powerful second material is minimized or directed by the like polarity of the surrounding first material. The magnetic flux lines are directed away from the second material of the adjacent magnet having an opposite polarity.

With particular reference to FIG. 3 there is shown a synchronous drive denoted generally by numeral 30. The drive 30 includes two confronting sides 32 and 34. Each side includes an iron back plate 36 and 38, respectively. Each of the magnets 40, shown in FIG. 4, is attached coaxially with a fixed air gap between the magnets 40. Each of the adjacent magnets 40 has an alternating polarity, e.g. north pole, south pole.

The magnetic circuit formed by the synchronous drive in FIG. 3 is shown clearly in FIG. 5. A first magnet 40 has a front face with a north pole and edges 42 and 44. A second magnet 40 has a front face with a south pole and edges 46 and 48. It will be noted that edges 44 and 46 are directly adjacent one another across the air gap. The edges 42, 44, 46 and 48 are made from the first magnetic material and are of opposite polarity, north and south. The opposite polarity of the first materials of sides 44 and 46 causes magnetic flux lines to be created across the air gap. These flux lines vary in strength depending on the strength or energy product of the first material.

The flux lines of the first material across the gap cause the flux lines of the opposite-polarity second material to be bowed distortedly. Thus the flux lines of the second material are bowed or directed away from the air gap which would cause leakage. The more the flux lines of the second stronger magnetic material are directed away from the air gap, the less leakage in the system, thus greater efficiency of the system.

The air gap between composite magnets may be large or small depending on the criteria for the circuit design. In the case where space is extremely limited, such as the synchronous drive shown and described herein, the air gap is very small. In some cases the air gap is no larger than a layer of glue or epoxy. The epoxy is used to bond the composites together permanently.

Applicant has thusly invented a magnetic circuit, which by proper placement of expensive, high powered magnetic materials, more effectively uses the materials at a lower overall cost.

While the foregoing has described certain preferred embodiments of the invention in detail and with particularity, the foregoing is merely illustrative of the invention and is not meant to limit the invention. The invention is limited only by the appended claims.

I claim:

1. A composite magnet comprising:

at least a first discrete section of a first magnetic material, having a high residual magnetic strength, and an energy product greater than 3 million G-Oe;

a second discrete section of a second magnetic material comprising at least $\frac{1}{3}$ of the composite and dissimilar to the first material, having a high residual magnetic strength, at least a high energy product greater than 15 million G-Oe;

an intrinsic coercive force ($H_{ci}$) greater than 3000 Oe, the first material in contact with the second and the first material surrounding at least 30% of the surface area of the second material.

2. A composite magnet as set forth in claim 1, wherein there are at least 2 discrete first sections and the first material surrounds at least 2 sides of the second material.

3. A composite magnet as set forth in claim 1, wherein the energy product of the first material is between 3–12 million G-Oe and the energy product of the second material is greater than 17 million G-Oe.

4. A composite magnet as set forth in claim 3 wherein the second magnetic material is from the family of elements known as rare earth transition metals (RE-TM).

5. A composite magnet as set forth in claim 4 wherein the first magnetic material is barrium ferrite oxide ($BaFe_2O_3$).

6. A composite magnet as set forth in claim 4 wherein the first magnetic material is aluminum nickel cobalt (A1NiCo).

7. A magnetic circuit, comprising:

a plurality of composite magnets as set forth in claim 1;

the magnets being located adjacent one another and coaxially aligned;

the magnets being spaced apart by a fixed air gap, such that the first material of one magnet is directly adjacent the first material of another magnet;

each adjacent magnet being different in polarity thereby creating alternating north and south poles;

whereby strong lines of flux are created across the air gap by the directly adjacent first materials causing the lines of flux of adjacent second materials to be bowed away from the air gap.

* * * * *